US012584325B2

(12) United States Patent
Cutler et al.

(10) Patent No.: US 12,584,325 B2
(45) Date of Patent: Mar. 24, 2026

(54) FLEXIBLE CORNER FOR A TEMPORARY WALL SYSTEM

(71) Applicant: STARC Systems, Inc., Brunswick, ME (US)

(72) Inventors: Amelia Cutler, Scarborough, ME (US); Bruce Bickford, Cushing, ME (US); William Randall, Brunswick, ME (US); Darrell Flagg, Turner, ME (US)

(73) Assignee: STARC Systems, Inc., Brunswick, ME (US)

( * ) Notice: Subject to any disclaimer, the term of this patent is extended or adjusted under 35 U.S.C. 154(b) by 252 days.

(21) Appl. No.: 18/378,402

(22) Filed: Oct. 10, 2023

(65) Prior Publication Data

US 2025/0116128 A1 Apr. 10, 2025

(51) Int. Cl.
*E04G 21/24* (2006.01)

(52) U.S. Cl.
CPC ..... *E04G 21/243* (2013.01)

(58) Field of Classification Search
CPC ..... E04G 21/243; E04B 2/72; E04B 2/721; E04B 2/74; E04B 2/7401; E04B 2/7448; E04B 2/82; E04B 2/828; E04B 2/827; E04B 2002/749; E04B 2002/7492; E04B 2002/7487
USPC ..... 52/243.1
See application file for complete search history.

(56) References Cited

U.S. PATENT DOCUMENTS 2,107,624 A * 2/1938 Berger ..... E04B 2/821 52/476
3,332,182 A * 7/1967 Mark ..... E04B 2/7453 411/116
3,695,330 A * 10/1972 Hasbrouck ..... E05D 1/02 136/238
3,802,146 A * 4/1974 Tacke ..... E04B 2/7431 52/656.1
4,144,924 A * 3/1979 Vanden Hoek ..... E05D 5/0238 16/225
4,535,577 A * 8/1985 Tenser ..... E04B 2/7429 174/495
4,610,118 A * 9/1986 Fullenkamp ..... A61G 12/004 52/240

(Continued)

FOREIGN PATENT DOCUMENTS

CA 2997063 A1 * 9/2018 ..... E04B 2/7854
DE 20303250 U1 * 6/2003 ..... A47B 17/02

(Continued)

*Primary Examiner* — Ryan D Kwiecinski
(74) *Attorney, Agent, or Firm* — Crowe & Dunlevy LLC

(57) ABSTRACT

A hinge joint connects a first barrier to a second barrier of a wall which partitions a space. The hinge joint includes a female part connecting to the first barrier and including first and second pieces slidable relative to each other in setting a height of the hinge joint assembly to fit the ceiling height of the space. The hinge joint further includes a male part connecting to the second barrier and including third and fourth pieces which are slidable relative to each other in setting the height of the hinge joint assembly to fit the ceiling height of the space. Edges of the first and second pieces include at least one latch slot configured to retain a fixed latch pin of the first barrier. Edges of the third and fourth pieces include at least one retractable latch pin configured to engage a latch slot of the second barrier.

25 Claims, 12 Drawing Sheets

(56) References Cited

U.S. PATENT DOCUMENTS 5,054,255 A * 10/1991 Maninfior ..... E04B 2/7425 52/584.1
5,433,046 A * 7/1995 MacQuarrie ..... E04B 2/7422 52/240
5,711,128 A * 1/1998 Kordelin ..... E04B 1/6162 52/579
5,816,001 A * 10/1998 Goodman ..... A47B 57/425 52/36.6
5,873,205 A * 2/1999 Hanlon ..... E04B 2/7416 49/404
6,023,896 A * 2/2000 Rothschild ..... E04B 2/824 52/745.1
6,435,253 B1 * 8/2002 Steeves ..... E04B 2/7425 160/222
7,093,398 B2 * 8/2006 Spransy ..... E04B 2/7448 160/369
D554,919 S * 11/2007 Clark ..... D6/702
D571,130 S * 6/2008 Clark ..... D6/702
D571,131 S * 6/2008 Clark ..... D6/702
7,946,435 B2 * 5/2011 Clark ..... A47F 5/108 211/189
8,046,957 B2 * 11/2011 Towersey ..... E04B 2/7424 52/79.9
10,041,249 B1 * 8/2018 Hebert ..... E04G 21/243
10,233,635 B2 * 3/2019 Vehniäinen ..... E04B 2/821
10,329,760 B2 * 6/2019 Harber ..... E04B 2/827
11,473,368 B2 * 10/2022 Prodromou ..... E05D 9/005
11,746,524 B2 * 9/2023 Narbutas ..... E04B 2/824 52/238.1
11,952,774 B1 * 4/2024 Asiala, Jr. ..... E04B 2/827
12,024,910 B2 * 7/2024 Asiala, Jr. ..... E04G 21/243
12,054,942 B2 * 8/2024 Bickford ..... E04B 2/7411
12,163,330 B2 * 12/2024 Asiala, Jr. ..... E04B 2/821
12,281,472 B2 * 4/2025 Patton ..... E04B 2/7433
12,305,388 B2 * 5/2025 Bickford ..... E04B 1/6141
2002/0170687 A1 * 11/2002 Wright ..... E06B 3/485 160/229.1
2011/0138719 A1 * 6/2011 Gosling ..... E04B 2/7405 403/220
2011/0173925 A1 * 7/2011 Brown ..... E04C 2/386 52/794.1
2013/0186023 A1 * 7/2013 Nobile ..... E04B 2/7427 52/745.11
2014/0033642 A1 * 2/2014 Foran ..... E04G 21/30 52/782.1
2018/0251975 A1 * 9/2018 Harber ..... E04B 2/7448
2019/0186129 A1 * 6/2019 Hauserman-Winder ..... E04B 2/7453
2022/0081963 A1 * 3/2022 Whittemore ..... E06B 5/025
2022/0090398 A1 * 3/2022 Whittemore ..... E04G 21/30
2024/0254762 A1 * 8/2024 Asiala, Jr. ..... E04B 2/821
2025/0116128 A1 * 4/2025 Cutler ..... E04G 21/243

FOREIGN PATENT DOCUMENTS

GB 2329333 A * 3/1999 ..... A47G 5/00
GB 2431187 A * 4/2007 ..... E06B 11/02
WO WO-2018091390 A1 * 5/2018 ..... E04B 2/00
WO WO-2018158986 A1 * 9/2018 ..... F24F 13/02

* cited by examiner

FLEXIBLE CORNER FOR A TEMPORARY WALL SYSTEM

TECHNICAL FIELD

The present invention generally relates to a temporarily installed wall system for use in partitioning a space in construction and remodeling projects and, more particularly, to a hinge joint assembly providing a flexible corner between adjacent barriers of the wall system.

BACKGROUND

During the construction or remodeling of a building interior it is often desirable to temporarily partition the space. In one conventional solution, a temporary wall is constructed. The temporary wall may be a soft barrier (such as a plastic sheet) or hard barrier (comprising a light duty wall constructed on site from wood or gypsum panels mounted to a frame which is attached to the walls, ceiling and floor). A further advancement in the art provides for the installation of a plurality of prefabricated barriers that can be mated with each other to form a partition-wall. These prefabricated barriers are typically reusable following completion of the project.

SUMMARY

In an embodiment, a wall for partitioning a space comprises: a first barrier comprising overlapping first and second panels which are slidable relative to each other in setting a height of the first barrier to fit a ceiling height of the space; wherein an edge of the first panel of the first barrier includes at least one fixed latch pin and an edge of the second panel of the first barrier does not include any fixed latch pins; a second barrier comprising overlapping first and second panels which are slidable relative to each other in setting a height of the second barrier to fit the ceiling height of the space; wherein an edge of the first panel of the second barrier includes at least one latch slot and an edge of the second panel of the second barrier does not include any latch slots; and a hinge joint assembly including: a female part configured for connection to the first barrier and including first and second pieces which are slidable relative to each other in setting a height of the hinge joint assembly to fit the ceiling height of the space; an edge of each of the first and second pieces includes at least one latch slot; and a male part configured for connection to the second barrier and including third and fourth pieces which are slidable relative to each other in setting the height of the hinge joint assembly to fit the ceiling height of the space; wherein an edge of each of the third and fourth pieces includes at least one retractable latch pin.

In a first orientation of the hinge joint assembly: the at least one fixed latch pin at the edge of the first panel of the first barrier engages the at least one latch slot at the edge of the first piece of the female part; the at least one retractable pin at the edge of the third piece of the male part engages the at least one latch slot at the edge of the first panel of the second barrier; and the at least one retractable pin at the edge of the fourth piece of the male part is pushed by the edge of the second panel of the second barrier into a retracted position.

In a second orientation of the hinge joint assembly upside down from the first orientation: the at least one fixed latch pin at the edge of the first panel of the first barrier engages the at least one latch slot at the edge of the second piece of the female part; the at least one retractable pin at the edge of the third piece of the male part engages the at least one latch slot at the edge of the second panel of the second barrier; and the at least one retractable pin at the edge of the fourth piece of the male part is pushed by the edge of the first panel of the second barrier into the retracted position.

A hinge joint assembly connects between a first barrier and a second barrier of a wall configured to partition a space. The hinge joint assembly comprises: a female part configured for connection to the first barrier and including first and second pieces which are slidable relative to each other in setting a height of the hinge joint assembly to fit the ceiling height of the space; wherein an edge of each of the first and second pieces includes at least one latch slot configured to retain a fixed latch pin of the first barrier; and a male part configured for connection to the second barrier and including third and fourth pieces which are slidable relative to each other in setting the height of the hinge joint assembly to fit the ceiling height of the space; wherein an edge of each of the third and fourth pieces includes at least one retractable latch pin configured to engage a latch slot of the second barrier.

In a first orientation of the hinge joint assembly: the fixed latch pin of the first barrier engages the at least one latch slot at the edge of the first piece of the female part; the at least one retractable pin at the edge of the third piece of the male part engages the latch slot of the second barrier; and the at least one retractable pin at the edge of the fourth piece of the male part is pushed by an edge of the second barrier into a retracted position.

In a second orientation of the hinge joint assembly upside down from the first orientation: the fixed latch pin of the first barrier engages the at least one latch slot at the edge of the second piece of the female part; the at least one retractable pin at the edge of the fourth piece of the male part engages the latch slot of the second barrier; and the at least one retractable pin at the edge of the third piece of the male part is pushed by the edge of the second barrier into the retracted position.

BRIEF DESCRIPTION OF THE DRAWINGS

For a better understanding of the embodiments, reference will now be made by way of example only to the accompanying figures in which.

DETAILED DESCRIPTION OF THE DRAWINGS

Figure 1:
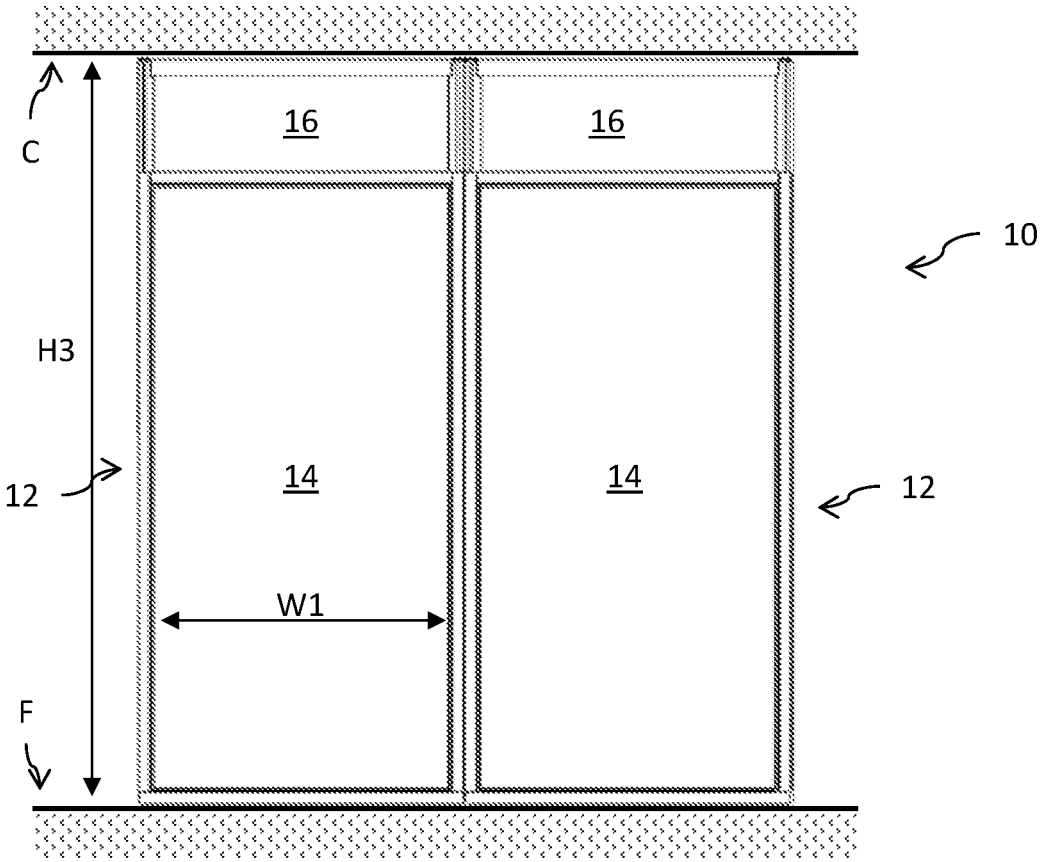
FIG. 1 shows a front view of a portion of a temporary wall formed by a plurality of prefabricated barriers.
Figure 2:
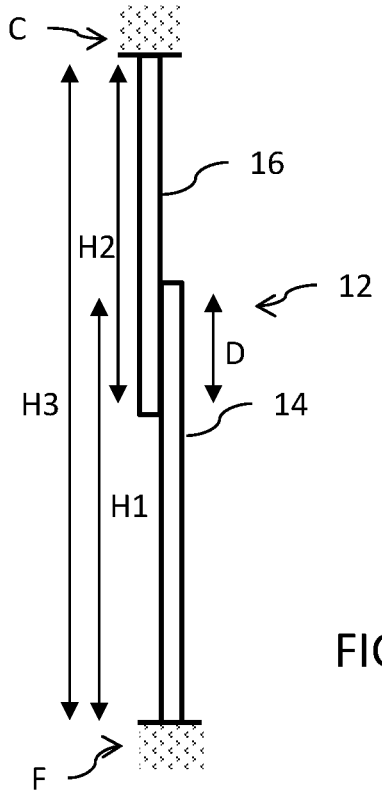
FIG. 2 shows a cross-sectional view of a barrier in the wall of FIG. 1.

FIG. 1 shows a front view of a portion of a temporary wall 10 formed by a plurality of prefabricated barriers 12, and FIG. 2 shows a cross-sectional view of a barrier 12 in the wall 10. Each barrier 12 is formed by a lower panel 14 having a first width W1 and a first height H1 and an upper panel 16 having the first width W1 and a second height H2. The upper panel 16 is slidably attached in an overlapping (by a variable distance D) and telescoping fashion to the lower panel 14. In this way, the overall height H3 of the barrier 12 can be adjusted on site to match the height from the floor F to the ceiling C of the space in which the temporary wall 10 is installed.

An elastomer strip or gasket may be provided mounted to the lower edge of the lower panel 14 to provide a dust seal against the floor F of the space. If necessary to secure the positioning of the lower panel 14, mounting clips may be attached to the lower edge of the lower panel 14 and secured to the floor F. An elastomer strip or gasket may be provided mounted to the upper edge of the upper panel 16 to provide a dust seal against the ceiling C of the space. If necessary to secure the positioning of the upper panel 16, mounting clips may be attached to the upper edge of the upper panel 16 and secured to the ceiling C. In installations wherein the ceiling C is of the suspended or drop type, a friction-based retention of the upper edge of the upper panel 16 is not practical and an attachment mechanism can be installed to the structure (for example, grid) of the suspended or drop type ceiling in support of the top of the wall.

Figure 3A:
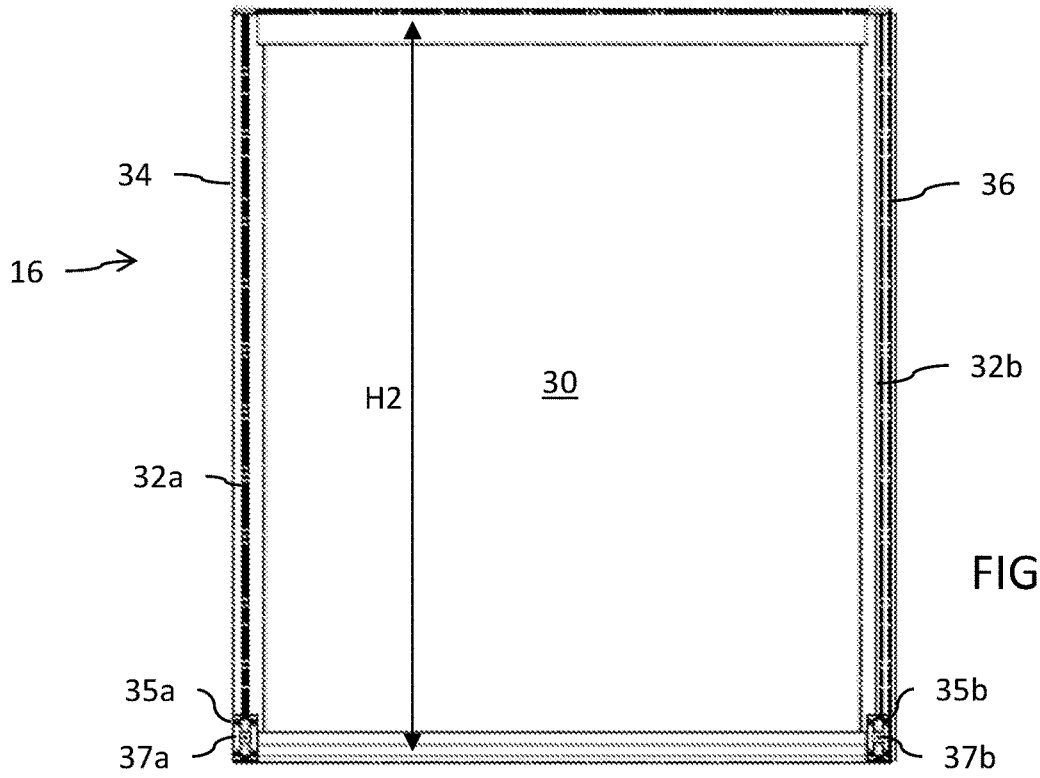
FIGS. 3A and 3B plan views of panels in the barrier shown in FIGS. 1 and 2.
Figure 3B:
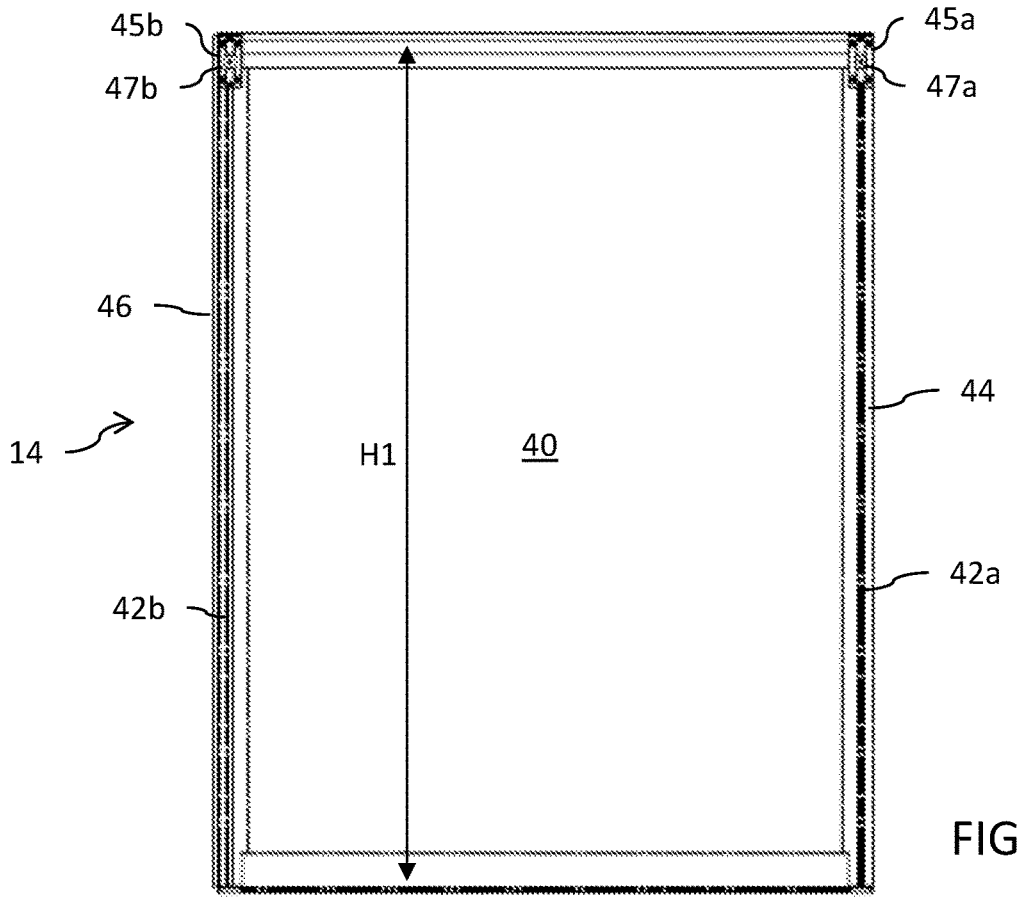

FIG. 3A shows a plan view towards the front face 30 of the upper panel 16 and FIG. 3B shows a plan view towards the back face 40 of the lower panel 14. The front face 30 of the upper panel 16 includes a first T-slot 32*a* which extends adjacent to a left (or female) edge 34 along the length of the second height H2, and a second T-slot 32*b* which extends adjacent to a right (or male) edge 36 along the length of the second height H2. A first rail 35*a*, also referred to as a bearing, with a projecting first T-flange 37*a* is mounted to the front face 30 of the upper panel 16 at the bottom corner aligned with the first T-slot 32*a*. A second rail 35*b* (or bearing) with a projecting second T-flange 37*b* is mounted to the front face 30 of the upper panel 16 at the opposite bottom corner aligned with the second T-slot 32*b*.

The rear face 40 of the lower panel 14 includes a third T-slot 42*a* which extends adjacent to a left (or female) edge 44 along the length of the first height H1, and a fourth T-slot 42*b* which extends adjacent to a right edge 46 along the length of the first height H1. A third rail 45*a* (or bearing) with a projecting third T-flange 47*a* is mounted to the rear face 40 of the lower panel 14 at the upper corner aligned with the third T-slot 42*a*. A fourth rail 45*b* (or bearing) with a projecting second T-flange 47*b* is mounted to the rear face 40 of the lower panel 14 at the opposite upper corner aligned with the fourth T-slot 42*b*.

Each rail 35*a*, 35*b*, 45*a*, 45*b* is mounted to the panel face 30, 40 by screws.

The rails 35*a*, 35*b*, 45*a*, 45*b* provide a smooth rubbing or bearing surface for the panel faces 30, 40 to move against. The lower panel 14 and upper panel 16 are assembled to each other with: the projecting first T-flange 37*a* of the first rail 35*a* for the upper panel 16 inserted within the third T-slot 42*a* of the lower panel 14; the projecting second T-flange 37*b* of the second rail 35*b* for the upper panel 16 inserted within the fourth T-slot 42*b* of the lower panel 14; the projecting third T-flange 47*a* of the third rail 45*a* for the lower panel 14 inserted within the first T-slot 32*a* of the upper panel 16; and the projecting fourth T-flange 47*b* of the fourth rail 45*b* for the lower panel 14 inserted within the second T-slot 32*b* of the upper panel 16.

Figure 4A:
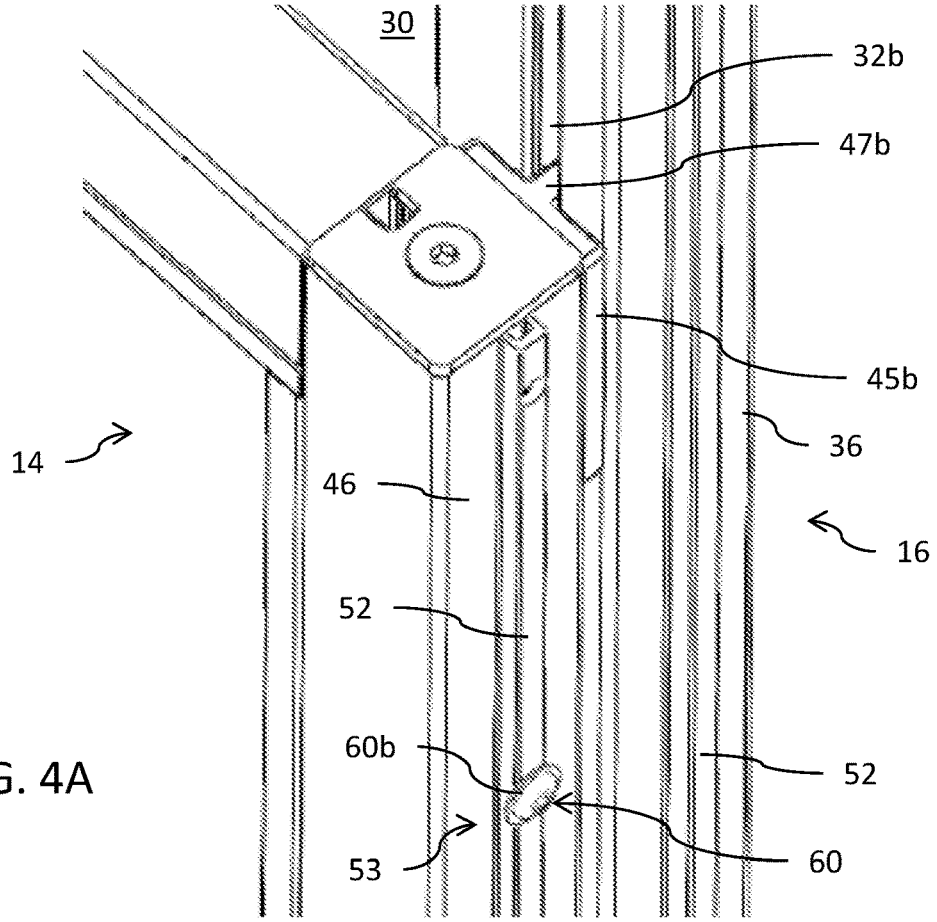
FIGS. 4A and 4B show perspective views of portions of the panels supporting telescoping.
Figure 4B:
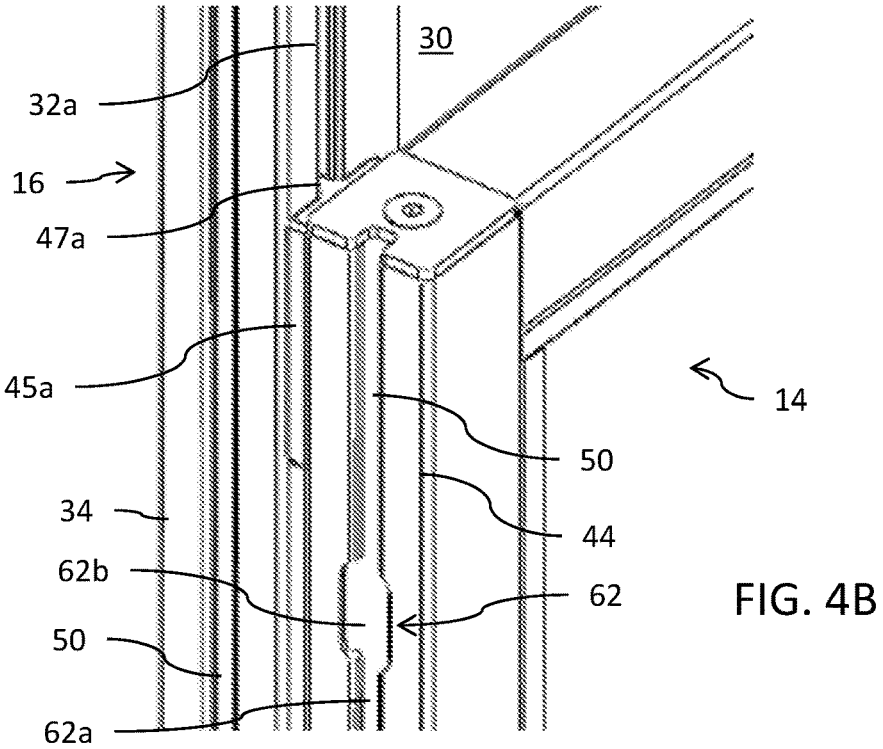

FIGS. 4A and 4B illustrate perspective views showing panel interconnection using the T-flanges of the rails engaged within the T-slots. These figures, in particular, illustrate the projecting third T-flange 47*a* of the third rail 45*a* for the lower panel 14 inserted within the first T-slot 32*a* of the upper panel 16 and the projecting fourth T-flange 47*b* of the fourth rail 45*b* for the lower panel 14 inserted within the second T-slot 32*b* of the upper panel 16. Although not shown in FIGS. 4A and 4B, it will be understood that below the illustrated engagement of the T-flanges for the third and fourth rails 45*a*, 45*b* at the top of the lower panel 14 with the T-slots 32*a*, 32*b* of the upper panel 16, there is also an engagement of the T-flanges for the first and second rails 35*a*, 35*b* at the bottom of the upper panel 16 with the T-slots 42*a*, 42*b* of the lower panel 14.

The sliding of the T-flanges along the T-slots supports the telescoping of the upper panel 16 relative to the lower panel 14 to provide the barrier 12 with the adjustable third height H3. When the upper panel 16 is raised to the desired height H3 for the barrier 12, it is locked into place by the use of locking screws or clips (not explicitly shown but which are configured, for example, through a screw tightening to clamp the panel against the bearing surfaces of the rails).

The opposed panel faces of the lower panel 14 are substantially planar and may optionally include texturing and/or decoration. The opposed panel faces of the upper panel 16 are substantially planar and may optionally include texturing and/or decoration. As elastomer strip or gasket may be provided on each of the faces 30 and 40 at the zone of overlap D for the telescoping panels 14 and 16 to provide a dust seal between the overlapping panels.

The side faces at the left (female) edges 34 and 44 of the upper panel 16 and lower panel 14, respectively, each include a groove 50 which extends along the length of the panel height (H2 and H1, respectively). The side faces at the right (male) edges 36 and 46 of the upper panel 16 and lower panel 14, respectively, each include a tongue 52 which extends along the length of the panel height (H2 and H1, respectively). The tongues 52 of the upper panel 16 and lower panel 14 of one barrier 12*a* in the wall 10 are configured to engage (i.e., be inserted within) the grooves 50 of the upper panel 16 and lower panel 14 of an adjacent barrier 12*b* in the wall 10 as shown in the cross-sectional view of FIG. 5.

Figure 5:
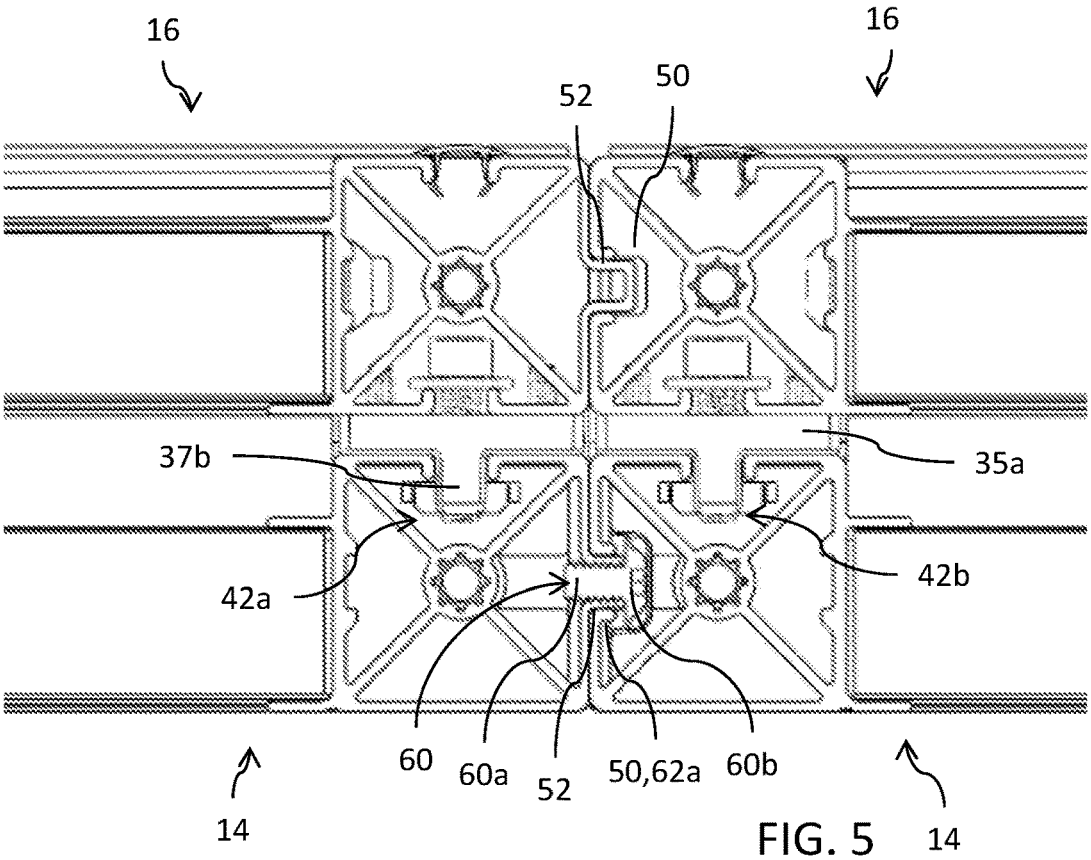
FIG. 5 shows a cross-sectional view at a side-by-side interconnection of adjacent barriers in the wall shown in FIG. 1.

Reference is now made to FIGS. 4A, 4B and 5 which illustrate aspects of a latching mechanism for an edge-to-edge interconnecting of two panels in a side-by-side linear configuration. The side face of the right (male) edge 46 of each lower panel 14 further includes a plurality of spaced apart latch pins 60 whose positions are aligned with the tongue 52. The tongue 52 may have a discontinuity 53 at the location of each latch pin 60. Each latch pin 60 comprises a pin shaft portion 60*a* extending perpendicularly away from the side face of the right edge 46 and a pin head portion 60*b* mounted at the distal end of the pin shaft portion. The pin head portion 60*b* is larger in size than the pin shaft portion 60*a*. The pin shaft portion 60*a* may be threaded in order to support making a tuning adjustment of the extension distance of the pin head portion 60*b* away from the face 46.

Figure 7A:
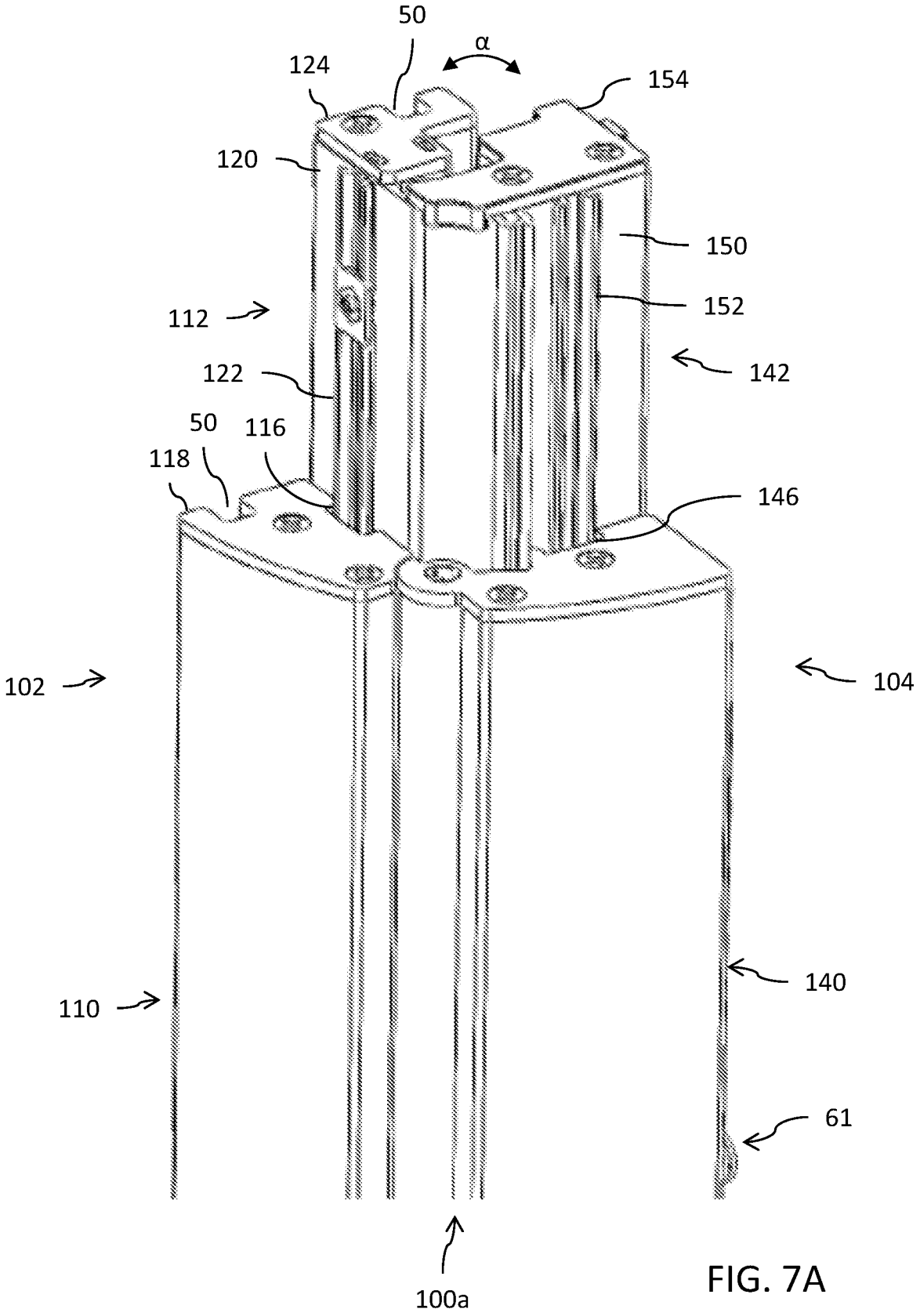
FIGS. 7A and 7B shows partial perspective views in two orientations for the hinge joint assembly.
Figure 7B:
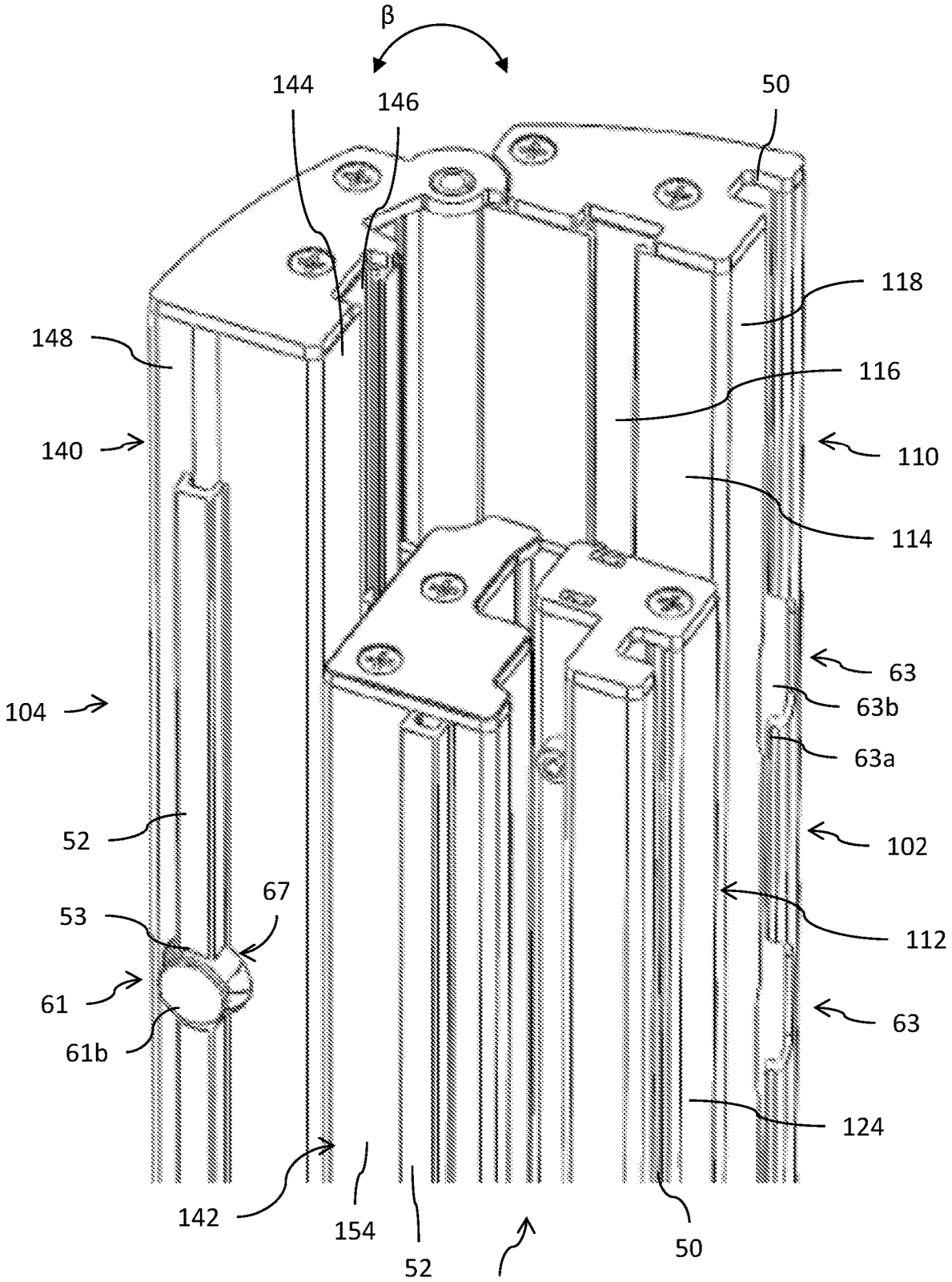

The groove 50 at the side face at the left (female) edge 44 of each lower panel 14 further includes a plurality of spaced apart latch openings 62. Each latch opening 62 comprises a slot portion 62*a* formed by the groove 50 and oriented to extend longitudinally along the length of the left edge 44 and a hole portion 62*b*. The slot portion 62*a* is larger in size than the pin shaft portion 60*a*. The hole portion 62*b* may, for example, be centered along the length of the slot portion 62*a* and is larger in size than the slot portion 62*a*, and is larger in size than the pin head portion 60*b*. In an embodiment, two hole portions 62*b* may be connected by a slot portion 62*a* to provide a latch opening 62 with a dog-bone shape (see, FIG. 7B.

When connecting two barriers 12 side-by-side, the pin head portion 60*b* of each latch pin 60 is inserted through the hole portion 62*b* of a corresponding latch opening 62, with the tongue 52 being inserted into the groove 50, and then shifted vertically (for example, moved downwardly) so that the shaft portion 60*a* of the latch pin 60 slips into the slot portion 62*a* of the latch opening 62 with the pin head portion 60*b* of the latch pin 60 being captured in the opening 62. The effect of this is to lock the side-by-side barriers 12 to each other in forming a segment or portion of the wall 10.

It will be noted that female edge of the upper panel 16 does not include any latch openings 62 aligned with the grooves 50 and the male edge of the upper panel 16 does not include any latch pins 60 aligned with the tongues 52. The reason for this is that there may be variation in height H3 along the length of a wall and it cannot be consistently assured that the pins and latch openings will align between adjacent upper panels 16. So, in the side-by-side interconnection of two barriers 12, latching using aligned pins and latch openings occurs solely between the adjacent lower panels 14.

Figure 6:
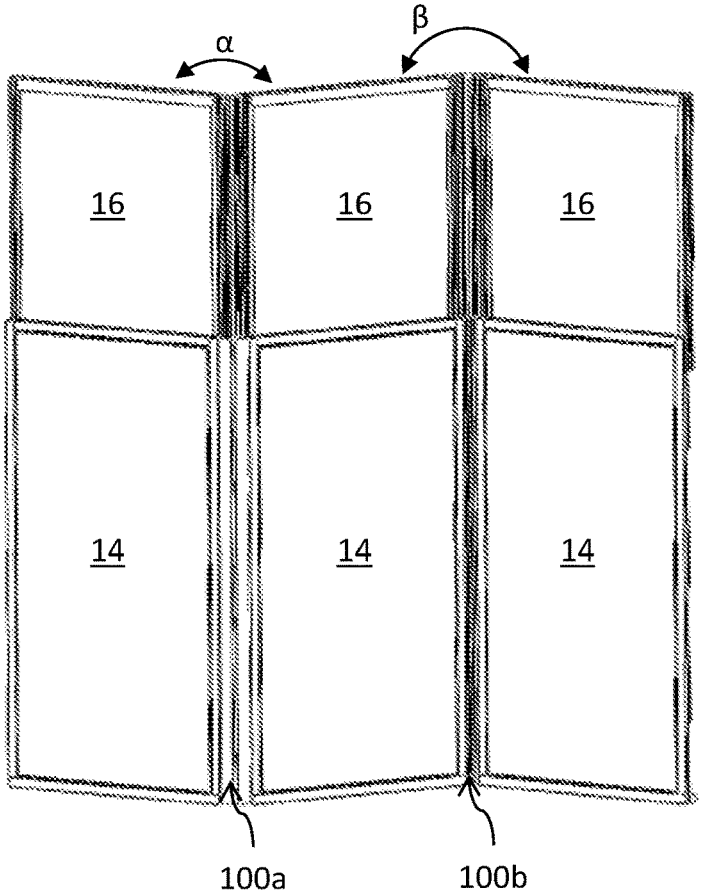
FIG. 6 shows a non-linear arrangement of barriers for a wall where adjacent barriers are interconnected by a hinge joint assembly.

Certain installations of the wall 10 may require a non-linear arrangement of barriers 12 as shown in FIG. 6. For example, there may exist portions or segments of the wall 10 that need to be joined to each other at an angle other than 180°. A corner with a 90° angle may be considered a common need for the wall 10, but non-90° angles may be needed in certain cases.

A hinge joint assembly 100 is accordingly provided in a first orientation (reference 100*a*, see partial perspective view in FIG. 7A) to interconnect two adjacent barriers 12 to each other at a selectable angle over a first angle range $\alpha$ from 90° to 180°. Additionally, by instead using a second orientation (reference 100*b*, see partial perspective view in FIG. 7B) of the hinge joint assembly 100, which is oriented "upside-down" relative to the first orientation, interconnection of the two adjacent barriers 12 can be made at a selectable angle over a second angle range $\beta$ from 180° to 270°.

Figure 8:
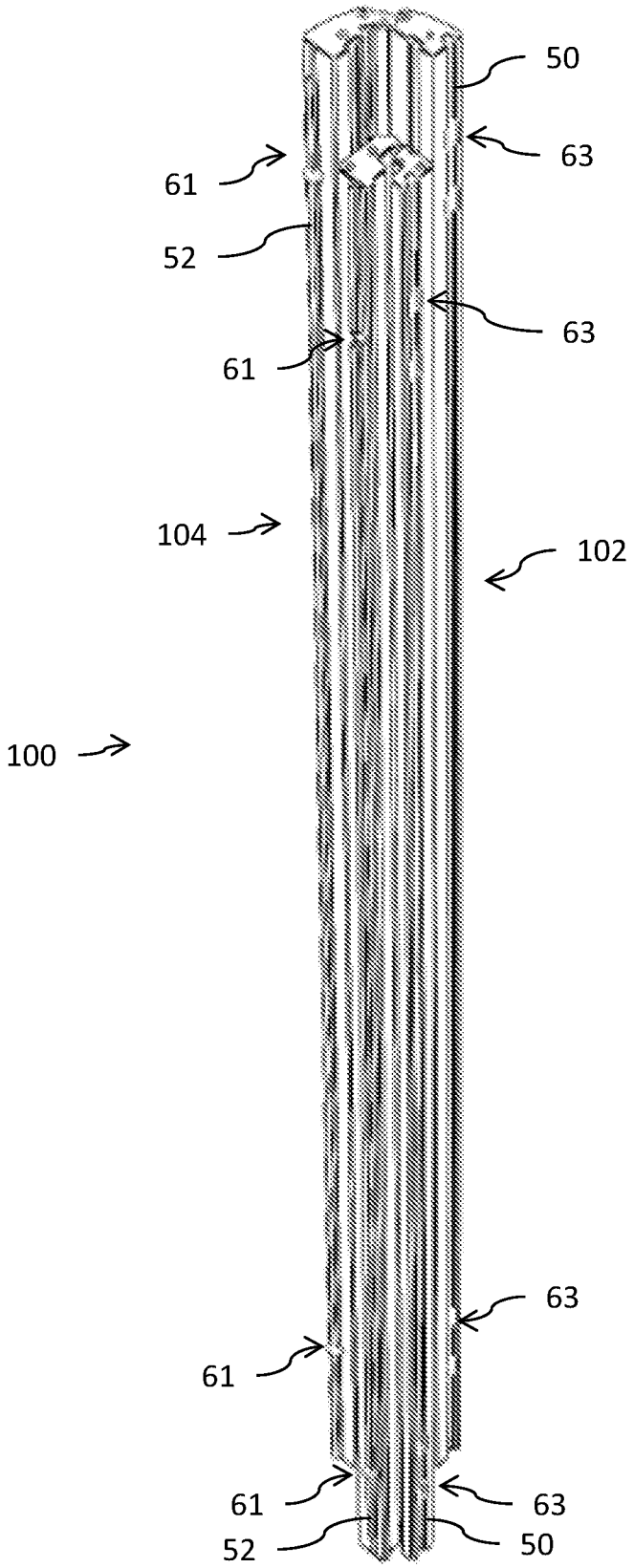
FIG. 8 is a perspective view of the hinge joint assembly.

Reference is further made to the perspective view of the hinge joint assembly 100 shown in FIG. 8. The hinge joint assembly 100 comprises a female part 102 (configured for mating interconnection with the tongue side (male) edge of an adjacent barrier 12) and a male part 104 (configured for mating interconnection with the groove side (female) edge of an adjacent barrier 12).

The female part 102 includes a first piece 110 and a second piece 112. The second piece 112 is slidably attached in an overlapping and telescoping fashion to the first piece 110. In this way, the overall height of the female part 102 of the hinge joint assembly 100 can be adjusted on site to match both the ceiling height of the space in which the temporary wall 10 is installed and the height H3 of the immediately adjacent barrier 12*a*.

A first face 114 of the first piece 110 includes a first T-slot 116 which extends adjacent to a side edge 118 along the length of the first piece. A second face 120 of the second piece 112 includes a first T-flange 122 which extends adjacent a side edge 124 along the length of the second piece. The first T-flange 122 is inserted within, and slides along, the first T-slot 116. The sliding of the T-flange 122 along the T-slot 116 supports the telescoping of the second piece 112 relative to the first piece 110 to provide the hinge joint assembly 100 with the adjustable third height H3. When the first piece 110 and second piece 112 are telescoped to the desired height H3 for the barrier 12, the relative positions of the pieces are locked into place by the use of locking screws or clips (not explicitly shown but which are configured, for example, through a screw tightening to clamp the first and second pieces to each other).

The faces of the side edges 118 and 124 of the first piece 110 and second piece 112, respectively, each include a groove 50 which extends along the length of the piece height. The tongue 52 at the faces of the right (male) edges 36 and 46 of the upper panel 16 and lower panel 14, respectively, of an adjacent barrier 12 are configured to engage (i.e., be inserted within) the grooves 50 of the second piece 112 and first piece 110 of the hinge joint assembly 100 when in the first orientation 100*a*. Conversely, when the hinge joint assembly 100 is instead in the second orientation 100*b*, the tongue 52 at the faces of the right edges 36 and 46 of the upper panel 16 and lower panel 14, respectively, of the adjacent barrier 12 are configured to engage (i.e., be inserted within) the grooves 50 of the first piece 110 and second piece 112 of the hinge joint assembly 100.

The faces of the side edges 118 and 124 of the first piece 110 and second piece 112, respectively, each further include a plurality of spaced apart latch openings 63 whose positions are aligned with the groove 50. Each latch opening 63 comprises a slot portion 63*a* that is integral with the groove and oriented to extend longitudinally along the length of the face of the side edges 118 and 124 and a hole portion 63*b*. The hole portion 63*b* is larger in size than the slot portion 63*a*.

When connecting the adjacent barrier 12 to the hinge joint assembly 100, the pin head portion 60*b* of each latch pin 60 is inserted through the hole portion 63*b* of a corresponding latch opening 63, with the tongue 52 being inserted into the groove 50, and then shifted vertically (for example, moved downwardly) so that the shaft portion 60*a* of the latch pin 60 slips into the slot portion 63*a* of the latch opening 63 with the pin head portion 60*b* of the latch pin 60 being captured in the opening 63. The effect of this is to lock the side-by-side barrier 12 and female part 102 of the hinge joint assembly 100. It will be noted that when the hinge joint assembly 100 is in the first orientation (reference 100*a*—FIG. 7A), the latch pins 60 at the face of the right edge 46 of the lower panel 14 of the adjacent barrier 12 are inserted through the hole portions 63*b* of the corresponding latch openings 63 in the side edge 118 of the first piece 110 of the female part 102. Conversely, when the hinge joint assembly 100 is in the second orientation (reference 100*b*—FIG. 7B), the latch pins 60 at the face of the right edge 46 of the lower panel 14 of the barrier 12*a* are instead inserted through the hole portions 63*b* of the corresponding latch openings 32 in the face of the side edge 124 of the second piece 112 of the female part 102.

The male part 104 of the hinge joint assembly 100 includes a third piece 140 and a fourth piece 142. The fourth piece 142 is slidably attached in an overlapping and telescoping fashion to the third piece 140. In this way, the overall height H3 of the male part 104 of the hinge joint assembly 100 can be adjusted on site to match both the ceiling height of the space in which the temporary wall 10 is installed and the height H3 of the immediately adjacent barrier 12*b*.

A third face 144 of the third piece 140 includes a second T-slot 146 which extends adjacent to a side edge 148 along the length of the third piece. A fourth face 150 of the fourth piece 142 includes a second T-flange 152 which extends adjacent a side edge 154 along the length of the fourth piece. The second T-flange 152 is inserted within, and slides along, the second T-slot 156. The sliding of the T-flange 152 along the T-slot 156 supports the telescoping of the fourth piece 142 relative to the third piece 140 to provide the hinge joint assembly 100 with the adjustable third height H3. When the third piece 140 and fourth piece 142 are telescoped to the desired height H3 for the barrier 12, the relative positions of the pieces are locked into place by the use of locking screws or clips (in the manner noted above).

The faces of the side edges 148 and 154 of the third piece 140 and fourth piece 142, respectively, each include a tongue 52 which extends along the length of the piece height. The tongues 52 at the faces of the side edges 148 and 154 of the third piece 140 and fourth piece 142, respectively, are configured to engage (i.e., be inserted within) the grooves 50 at the faces of the left edges 34 and 44 of the upper panel 16 and lower panel 14, respectively, of the adjacent barrier 12 when the hinge joint assembly 100 is in the first orientation (reference 100*a*—FIG. 7A). Conversely, when the hinge joint assembly 100 is instead in the second orientation (reference 100*b*—FIG. 7B), the tongues 52 at the faces of the side edges 148 and 154 of the third piece 140 and fourth piece 142, respectively, are configured to engage (i.e., be inserted within) the grooves 50 at the faces of the left edges 44 and 34 of the lower panel 14 and upper panel 16, respectively, of the adjacent barrier 12.

The faces of the side edges 148 and 154 of the third piece 140 and fourth piece 142, respectively, each further include a plurality of spaced apart retractable latch pins 61 whose positions are aligned with the tongue 52. The tongue 52 may have a discontinuity 53 at the location of each retractable latch pin 61. Each retractable latch pin 61 is installed within an opening 67 and comprises a pin shaft portion 61*a* extending perpendicularly away from the face of the edge 148, 154 and a pin head portion 61*b* mounted at the distal end of the pin shaft portion. The pin head portion 61*b* is larger in size than the pin shaft portion 61*a*. Unlike the latch pin 60 which is fixed in an extended position, the retractable latch pin 61 is spring loaded. The force exerted by the spring 65 within the opening 67 biases the retractable latch pin 61 in the extended position like the fixed extension of the latch pin 60. However, in response to force applied to the pin head portion 61*b*, the spring 65 is compressed and the pin 61 retracts within the opening 67.

Figure 10:
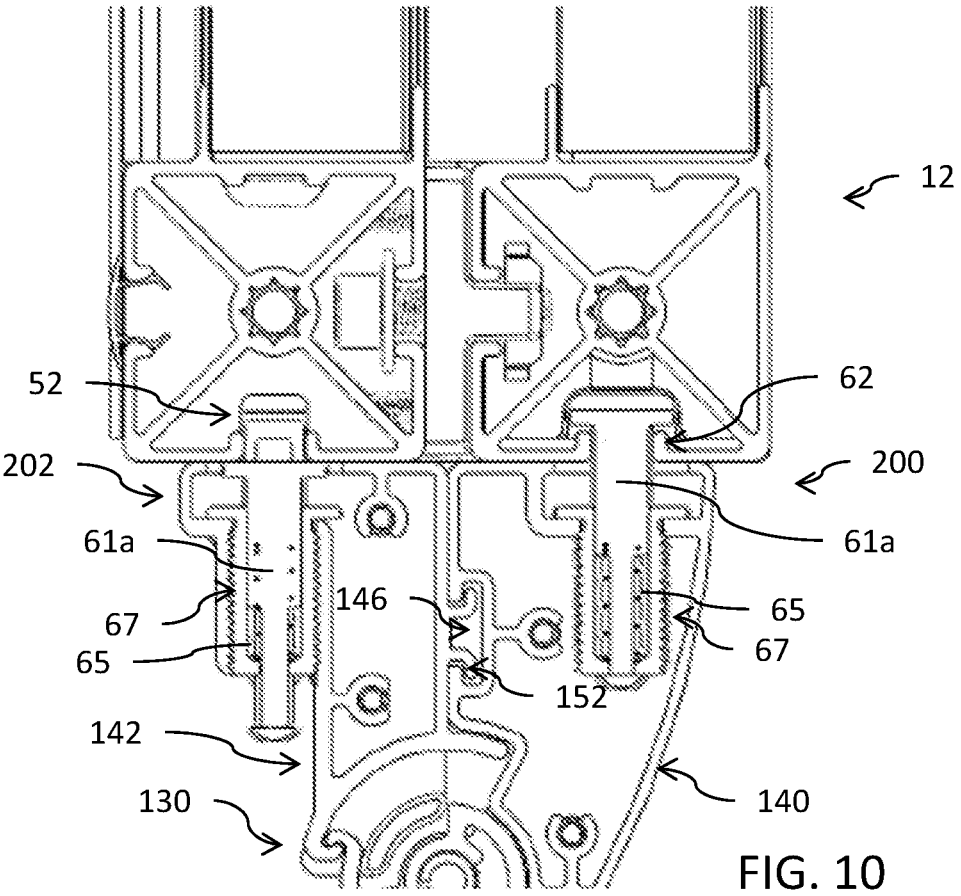
FIG. 10 is a cross-sectional view illustrating interconnection of the hinge joint assembly to a barrier.

When connecting the hinge joint assembly 100 to the adjacent barrier 12, the pin head portion 61*b* of certain ones of the retractable latch pins 61 are inserted through the hole portion 62*b* of a corresponding latch opening 62, with the tongue 52 being inserted into the groove 50, and then shifted vertically (for example, moved downwardly) so that the shaft portion 61*a* of the retractable latch pin 61 slips into the slot portion 62*a* of the latch opening 62 with the pin head portion 61*b* of the retractable latch pin 61 being captured in the opening 62. This is illustrated at reference 200 in FIG. 10 which illustrates in cross section the connection of the hinge joint assembly 100 to the adjacent barrier 12. However, for other ones of the retractable latch pins 61 that are not aligned with latch openings 62, the bottom of the groove 50 exerts a force against the pin head portion 61*b*, the spring 65 is compressed, and the latch pin 61 retracts within the opening 67. This is illustrated at reference 202 in FIG. 10. The effect of this is to lock the male part 104 of the hinge joint assembly 100 and the side-by-side adjacent barrier 12. It will be noted that when the hinge joint assembly 100 is in the first orientation, the retractable latch pins 61 at the side edge 148 of the third piece 140 are inserted through the hole portions 62*b* of the corresponding latch openings 62 in the side edge of 44 of the lower panel 14 (reference 200), and the retractable latch pins 61 at the side edge 154 of the fourth piece 142 are retracted because the side edge 34 of the upper panel 16 does not include latch openings 62 (reference 202). Conversely, when the hinge joint assembly 100 is in the second orientation, the retractable latch pins 61 at the side edge 154 of the fourth piece 142 are inserted through the hole portions 62*b* of the corresponding latch openings 62 in the side edge of 44 of the lower panel, and the retractable latch pins 61 at the side edge 148 of the third piece 140 are retracted because the side edge 34 of the upper panel 16 does not include latch openings 62.

It will be noted that the plunger mechanism holding the spring and retractable latch pin is threaded to mate with the opening 67. This threaded relationship permits making a tuning adjustment of the extension distance of the pin head portion 61*b* away from the face 148, 150.

With reference once again to FIGS. 9A and 9B, a hinge connection 130 is provided between the first piece 110 of the female part 102 and the third piece 140 of the male part 104. The hinge connection permits 90° of rotation of the first piece 110 of the female part 102 relative to the third piece 140 of the male part 104. In the first orientation of the hinge joint assembly 100, this relative rotation supports selecting an angle between the adjacent barriers 12*a* and 12*b* over the angle range from 90° to 180°. In the second orientation of the hinge joint assembly 100, this relative rotation supports selecting an angle between the adjacent barriers 12*a* and 12*b* over the angle range from 180° to 270°.

Figure 9A:
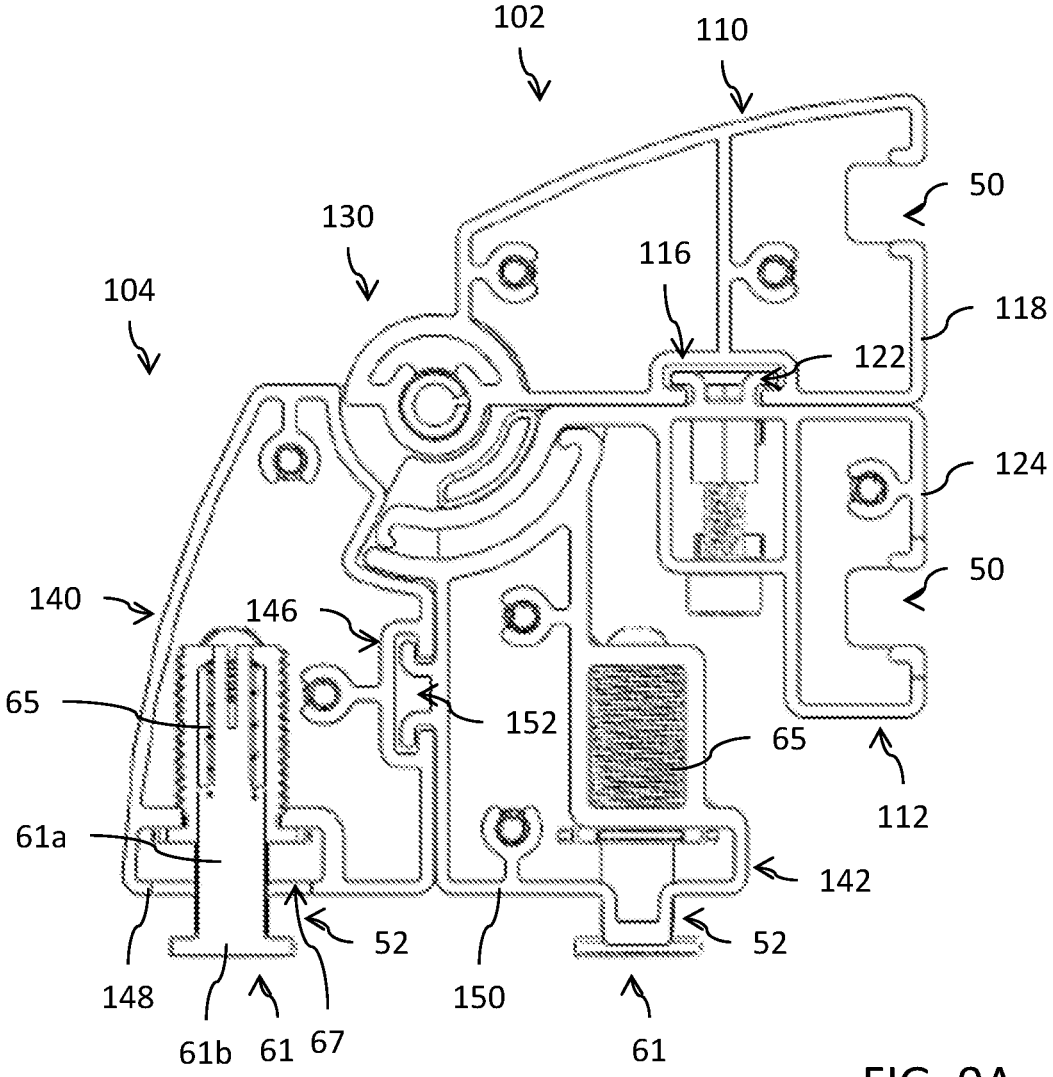
FIGS. 9A and 9B are cross-sectional views of the hinge joint assembly illustrating different opening angles.
Figure 9B:
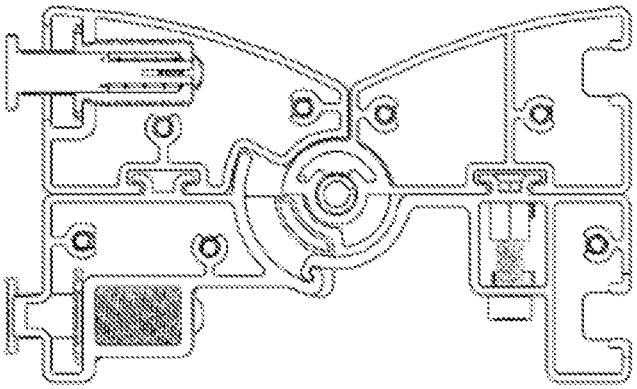
Figure 11:
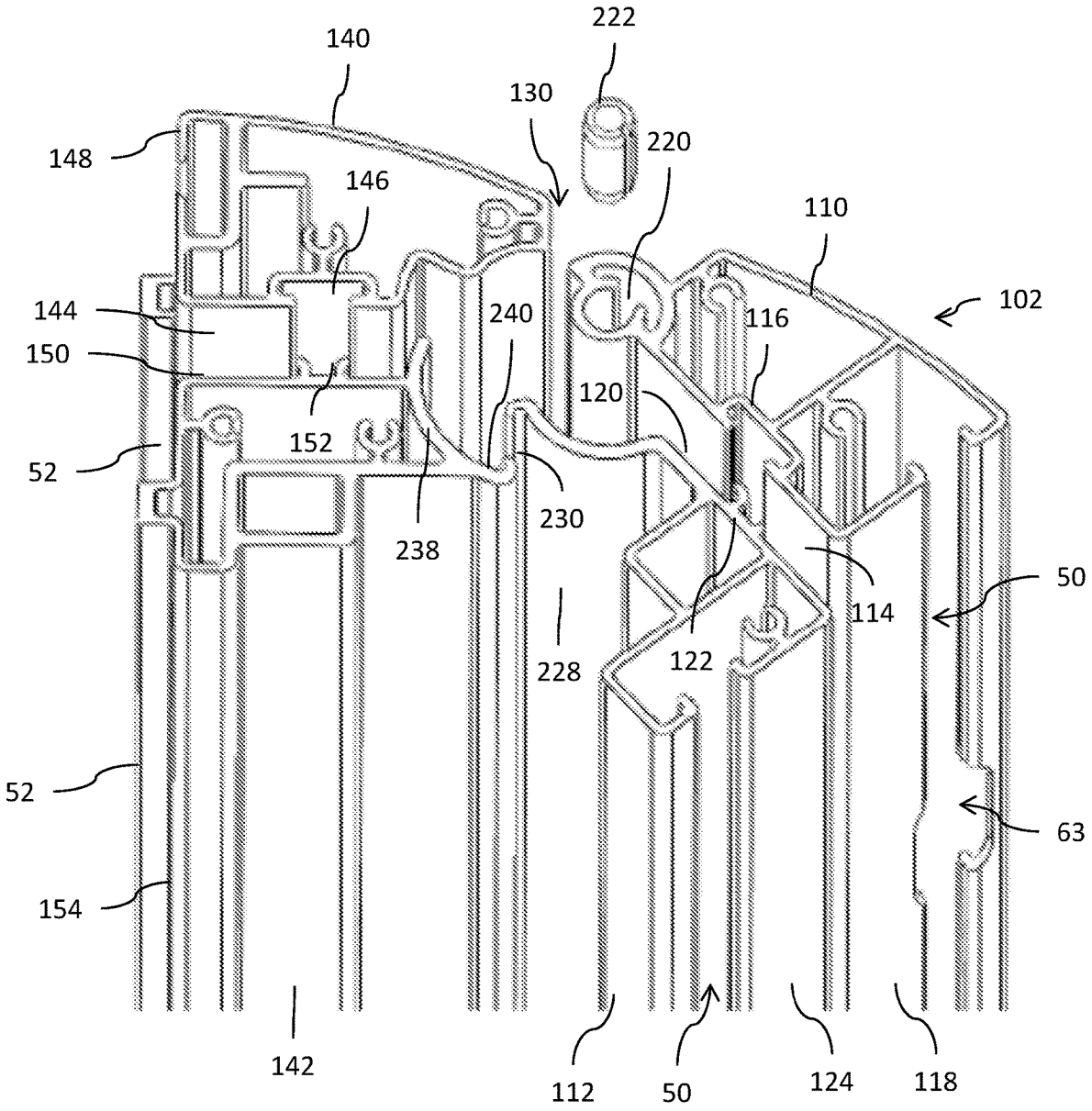
FIG. 11 is an exploded partial perspective view of the hinge joint assembly.

Reference is now made to FIG. 11 which shows an exploded perspective view of the hinge joint assembly 100 showing the profiles for the extrusions forming the first piece 110 and second piece 112 of the female part 102 and the third piece 140 and fourth piece 142 of the male part 104. The extrusion for the first piece 110 of the female part 102 defines the first face 114 with included first T-slot 116 and defines the face of the side edge 118 with included groove 50 and latch opening 63. The extrusion for the first piece 110 further defines a hinge opening 220 that is configured to receive a hinge pin 222. The first face 114 is aligned with the center of the hinge opening 220 and is oriented perpendicular to the face of the side edge 118. The extrusion for the second piece 112 of the female part 102 defines the second face 120 with included first T-flange 122, defines the face of the side edge 124 with included groove 50 and latch opening 63 and further defines an inner arcuate member 228 having a distal end with an outer hook 230. The second face 120 is oriented perpendicular to the face of the side edge 124. The inner arcuate member 228 is an extension of the second face 120. The extrusion for the third piece 140 of the male part 104 defines the third face 144 with included second T-slot 146, and defines the face of the side edge 148 with included tongue 52 (with discontinuities 53). The extrusion for the third piece 140 further defines the opening 67 at each discontinuity 53 for receiving the retractable latch pin 61 (as shown in FIGS. 9A and 9B). The third face 144 is oriented perpendicular to the face of the side edge 148. The extrusion for the fourth piece 142 of the male part 104 defines the fourth face 150 with included second T-flange 152, defines the face of the side edge 148 with included tongue 52 (with discontinuities 53) and further defines an outer arcuate member 238 having a distal end with an inner hook 240. The outer arcuate member 238 is an extension of the third face 144. The extrusion for the fourth piece 142 further defines the opening 67 at each discontinuity 53 for receiving the retractable latch pin 61 (as shown in FIGS. 9A and 9B). The fourth face 150 is oriented perpendicular to the face of the side edge 154.

With the hinge joint assembly 100 assembled, the inner arcuate member 228 and the outer arcuate member 238 are concentric with the hinge pin 222 inserted into the hinge opening 220. The outer hook 230 at the distal end of the inner arcuate member 228 is configured to engage the inner hook 240 at the distal end of the outer arcuate member 238 in order to preclude rotation of the female part 102 relative to the male part 104 at an angle greater than 180°. Furthermore, the extension lengths of the inner arcuate member 228 and the outer arcuate member 238 are configured preclude rotation of the female part 102 relative to the male part 104 at an angle smaller than 90°.

Figure 12A:
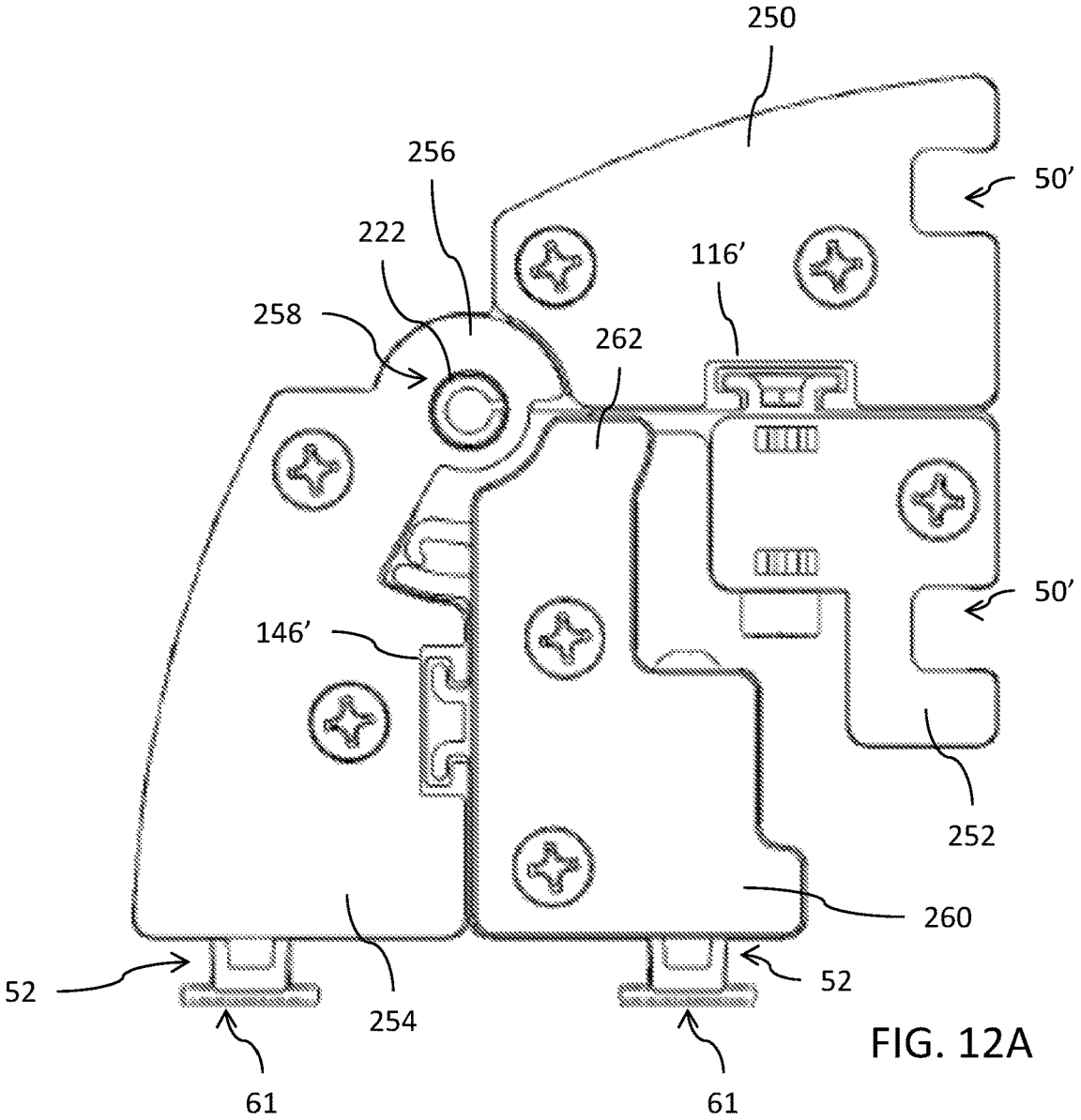
FIGS. 12A, 12B and 12C are end views of the hinge joint assembly illustrating different opening angles.
Figure 12B:
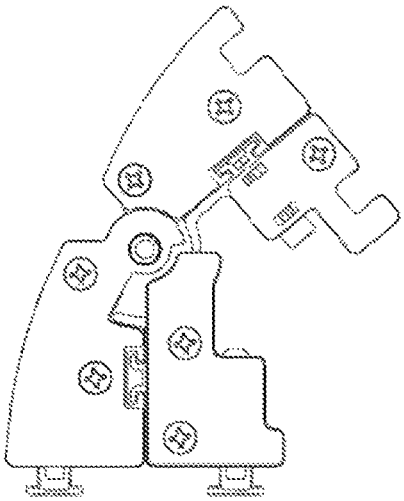
Figure 12C:
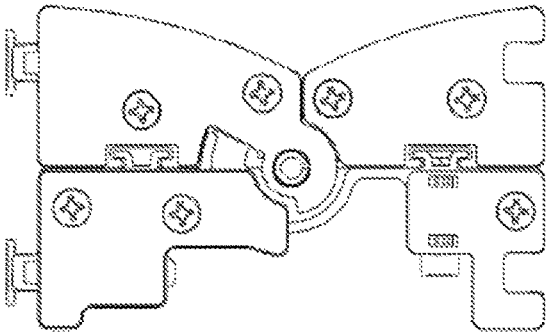
Figure 13:
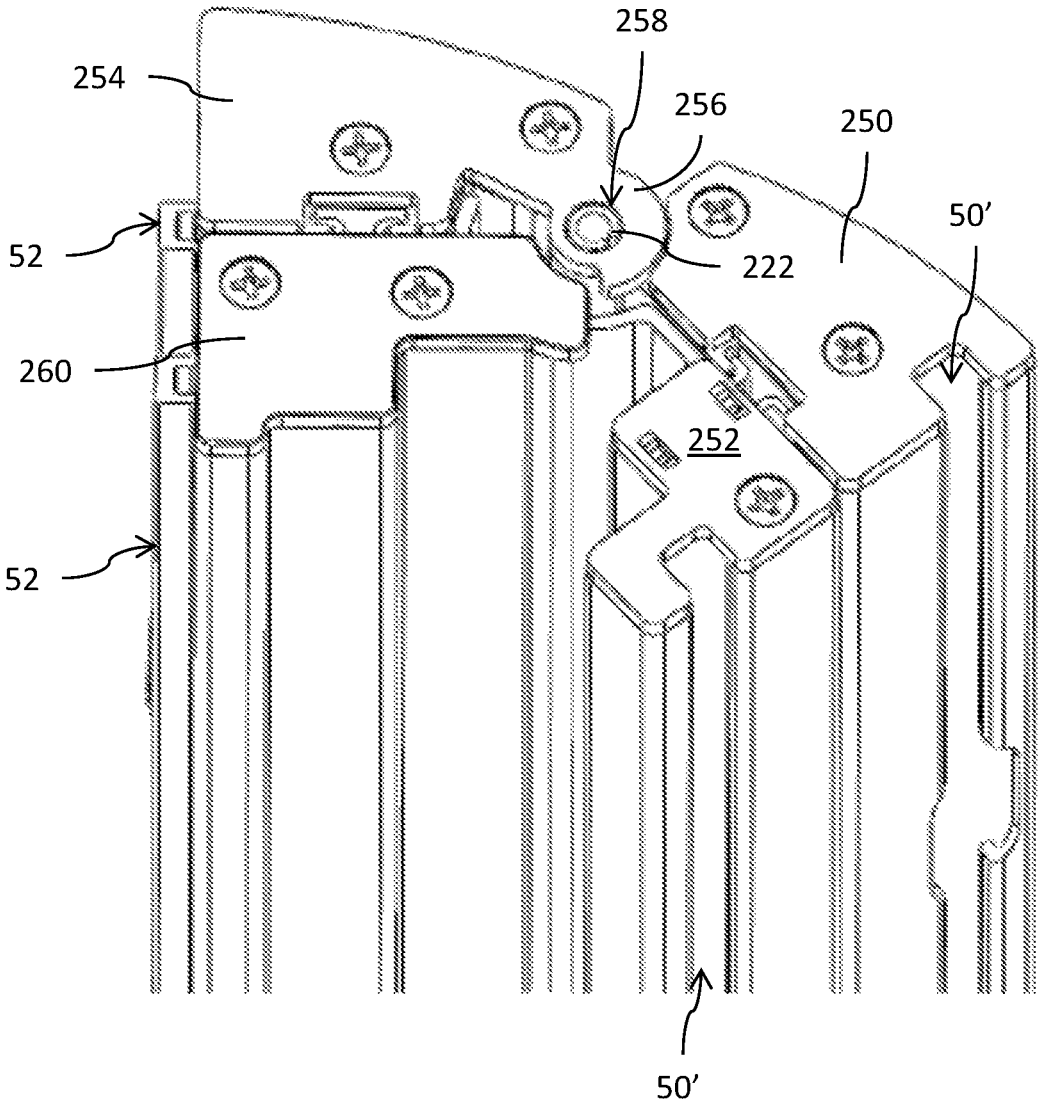
FIG. 13 is a perspective view of the hinge joint assembly shown in FIGS. 12A, 12B and 12C.

Reference is now made to FIGS. 12A-12C which show an end view of the hinge joint assembly 100 and FIG. 13 showing a perspective view. Cap plates (made, for example, and preferably, of steel) cover each of the ends of the profiles for the extrusions forming the first piece 110 and second piece 112 of the female part 102 and cover each of the ends of the profiles for the extrusions for the third piece 140 and fourth piece 142 of the male part 104. The opposed ends of the extrusion for the first piece 110 of the female part 102 are each covered by a first cap plate 250 attached to the extrusion by means of screws. The first cap plate 250 includes a groove 50' aligned with the groove 50 of the extrusion and a slot 116' aligned with the first T-slot 116 of the extrusion. Note that the first cap plate 250 does not extend to cover the hinge opening 220 of the extrusion for the first piece 110 or the hinge pin 222 which is inserted into the hinge opening 220. The opposed ends of the extrusion for the second piece 112 of the female part 102 are each covered by a second cap plate 252 attached to the extrusion by means of screws. The second cap plate 252 includes a groove 50' aligned with the groove 50 of the extrusion. Note that the second cap plate 252 does not extend to cover the inner arcuate member 228 of the extrusion for the second piece 112 of the female part 102. The opposed ends of the extrusion for the third piece 140 of the male part 104 are each covered by a third cap plate 254 attached to the extrusion by means of screws. The third cap plate 254 includes a hinge extension 256 (extending over the hinge opening 220 of the extrusion for the first piece 110 at each of the opposed ends) with a hinge opening 258 that captures the hinge pin 222, and further includes a slot 146' aligned with the second T-slot 146 of the extrusion. With a third cap plate 254 mounted at the opposed ends of the extrusion for the third piece 140 and extending with extension 256 over the opposed ends of the extrusion for the first piece 110, this ensures that the first and third pieces 110 and 140 move together and can be locked at the same relative height position. The opposed ends of the extrusion for the fourth piece 142 of the male part 104 are covered by a fourth cap plate 260 attached to the extrusion by means of screws. The fourth cap plate 260 includes a retention extension 262 that extends over at least a portion of each of the outer arcuate member 238 of the extrusion for the fourth piece 142 as well as extend over at least a portion of the inner arcuate member 228 of the extrusion for the second piece 112 of the female part 102. The retention extension 262 ensures that the second piece 112 of the female part 102 and second piece 142 of the male part 112 slide together in tandem.

While the invention has been illustrated and described in detail in the drawings and foregoing description, such illustration and description are considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

What is claimed is:

1. A wall for partitioning a space, comprising:

a first barrier comprising overlapping first and second panels which are slidable relative to each other in setting a height of the first barrier to fit a ceiling height of the space;

wherein an edge of the first panel of the first barrier includes at least one fixed latch pin and an edge of the second panel of the first barrier does not include any fixed latch pins;

a second barrier comprising overlapping first and second panels which are slidable relative to each other in setting a height of the second barrier to fit the ceiling height of the space;

wherein an edge of the first panel of the second barrier includes at least one latch slot and an edge of the second panel of the second barrier does not include any latch slots;

a hinge joint assembly including:

a female part configured for connection to the first barrier and including first and second pieces which are slidable relative to each other in setting a height of the hinge joint assembly to fit the ceiling height of the space;

wherein an edge of each of the first and second pieces includes at least one latch slot; and a male part configured for connection to the second barrier and including third and fourth pieces which are slidable relative to each other in setting the height of the hinge joint assembly to fit the ceiling height of the space;

wherein an edge of each of the third and fourth pieces includes at least one retractable latch pin;

wherein:

in a first orientation of the hinge joint assembly:

the at least one fixed latch pin at the edge of the first panel of the first barrier engages the at least one latch slot at the edge of the first piece of the female part;

the at least one retractable pin at the edge of the third piece of the male part engages the at least one latch slot at the edge of the first panel of the second barrier; and the at least one retractable pin at the edge of the fourth piece of the male part is pushed by the edge of the second panel of the second barrier into a retracted position; and in a second orientation of the hinge joint assembly upside down from the first orientation:

the at least one fixed latch pin at the edge of the first panel of the first barrier engages the at least one latch slot at the edge of the second piece of the female part;

the at least one retractable pin at the edge of the third piece of the male part engages the at least one latch slot at the edge of the second panel of the second barrier; and the at least one retractable pin at the edge of the fourth piece of the male part is pushed by the edge of the first panel of the second barrier into the retracted position.

2. The wall of claim 1, wherein each retractable pin at the edges of the third and fourth pieces of the male part is spring loaded to be biased towards an extended position opposite the retracted position.

3. The wall of claim 1, wherein the hinge joint assembly in the first orientation connects the first and second barriers with a first selectable angle range relative to each other, and wherein the hinge joint assembly in the second orientation connects the first and second barriers with a second selectable angle range relative to each other.

4. The wall of claim 3, wherein the first selectable angle range is from ninety degrees to one-hundred eighty degrees.

5. The wall of claim 3, wherein the second selectable angle range is from to one-hundred eighty degrees to two-hundred seventy degrees.

6. The wall of claim 1, wherein:

the edges of the first and second panels of the first barrier include a tongue;

the edges of the first and second pieces of the female part include a groove; and the tongues of the first and second panels are configured to engage the grooves of the first and second pieces.

7. The wall of claim 6, wherein the at least one latch slot at the edge of each of the first and second pieces of the female part is defined by the grooves of the first and second pieces and a latch opening larger than the groove which is configured to accept the at least one fixed latch pin.

8. The wall of claim 1, wherein:

the edges of the first and second panels of the second barrier include a groove;

the edges of the third and fourth pieces of the male part include a tongue; and the tongues of the third and fourth pieces are configured to engage the grooves of the first and second panels.

9. The wall of claim 8, wherein the at least one latch slot at the edge of the first panel of the second barrier is defined by the groove of the first panel and a latch opening larger than the groove which is configured to accept the at least one retractable pin.

10. The wall of claim 1, wherein the first piece of the female part is connected by a hinge to the third piece of the male part.

11. The wall of claim 10, wherein one of the first and third pieces includes a hinge opening, wherein the hinge includes a hinge pin inserted into the hinge opening and wherein the other of the first and third pieces includes a plate with an opening capturing the hinge pin.

12. The wall of claim 10, wherein one of the second and fourth pieces includes an inner arcuate member concentric with the hinge and having a distal end with an outer hook, wherein the other of the second and fourth pieces includes an outer arcuate member concentric with the hinge and having a distal end with an inner hook, and wherein said inner and outer hooks are configured to engage to preclude rotation of the female part relative to the male part at an angle greater than 180°.

13. The wall of claim 12, further comprising an end cap at opposite ends of one of the second piece of the female part or the fourth piece of the male part, wherein said end cap includes a retention extension which extends to cover over the inner and outer arcuate members to ensure that the second and fourth pieces slide in tandem relative to the first and third pieces.

14. A hinge joint assembly for connecting between a first barrier and a second barrier of a wall configured to partition a space, the hinge joint assembly comprising:

a female part configured for connection to the first barrier and including first and second pieces which are slidable relative to each other in setting a height of the hinge joint assembly to fit the ceiling height of the space;

wherein an edge of each of the first and second pieces includes at least one latch slot configured to retain a fixed latch pin of the first barrier; and a male part configured for connection to the second barrier and including third and fourth pieces which are slidable relative to each other in setting the height of the hinge joint assembly to fit the ceiling height of the space;

wherein an edge of each of the third and fourth pieces includes at least one retractable latch pin configured to engage a latch slot of the second barrier; and wherein the first and second pieces of the female part include a groove of a first tongue and groove assembly between the first barrier and the female part, and wherein the third and fourth pieces of the male part include a tongue of a second tongue and groove assembly between the male part and the second barrier.

15. The hinge joint assembly of claim 14, wherein in a first orientation of the hinge joint assembly:

the fixed latch pin of the first barrier engages the at least one latch slot at the edge of the first piece of the female part;

the at least one retractable pin at the edge of the third piece of the male part engages the latch slot of the second barrier; and the at least one retractable pin at the edge of the fourth piece of the male part is biased towards an extended position opposite a retracted position and pushed by an edge of the second barrier into the retracted position.

16. The hinge joint assembly of claim 15, wherein in a second orientation of the hinge joint assembly upside down from the first orientation:

the fixed latch pin of the first barrier engages the at least one latch slot at the edge of the second piece of the female part;

the at least one retractable pin at the edge of the fourth piece of the male part engages the latch slot of the second barrier; and the at least one retractable pin at the edge of the third piece of the male part is biased towards an extended position opposite a retracted position and pushed by an edge of the second barrier into the retracted position.

17. The hinge joint assembly of claim 16, wherein the hinge joint assembly in the first orientation connects the first and second barriers with a first selectable angle range relative to each other, and wherein the hinge joint assembly in the second orientation connects the first and second barriers with a second selectable angle range relative to each other.

18. The hinge joint assembly of claim 17, wherein the first selectable angle range is from ninety degrees to one-hundred eighty degrees.

19. The hinge joint assembly of claim 17, wherein the second selectable angle range is from to one-hundred eighty degrees to two-hundred seventy degrees.

20. The hinge joint assembly of claim 14, wherein each retractable pin at the edges of the third and fourth pieces of the male part is spring loaded to be biased towards an extended position opposite a retracted position.

21. The hinge joint assembly of claim 14, wherein the first piece of the female part is connected by a hinge to the third piece of the male part.

22. The hinge joint assembly of claim 21, wherein one of the first and third pieces includes a hinge opening, wherein the hinge includes a hinge pin inserted into the hinge opening and wherein the other of the first and third pieces includes a plate with an opening capturing the hinge pin.

23. A hinge joint assembly for connecting between a first barrier and a second barrier of a wall configured to partition a space, the hinge joint assembly comprising:

a female part configured for connection to the first barrier and including first and second pieces which are slidable relative to each other in setting a height of the hinge joint assembly to fit the ceiling height of the space;

wherein an edge of each of the first and second pieces includes at least one latch slot configured to retain a fixed latch pin of the first barrier; and a male part configured for connection to the second barrier and including third and fourth pieces which are slidable relative to each other in setting the height of the hinge joint assembly to fit the ceiling height of the space;

wherein an edge of each of the third and fourth pieces includes at least one retractable latch pin configured to engage a latch slot of the second barrier;

wherein the first piece of the female part is connected by a hinge to the third piece of the male part; and wherein one of the second and fourth pieces includes an inner arcuate member concentric with the hinge and having a distal end with an outer hook, wherein the other of the second and fourth pieces includes an outer arcuate member concentric with the hinge and having a distal end with an inner hook, and wherein said inner and outer hooks are configured to engage to preclude rotation of the female part relative to the male part at an angle greater than 180°.

24. The hinge joint assembly of claim 23, further comprising an end cap at opposite ends of one of the second piece of the female part or the fourth piece of the male part, wherein said end cap includes a retention extension which extends to cover over the inner and outer arcuate members to ensure that the second and fourth pieces slide in tandem relative to the first and third pieces.

25. The hinge joint assembly of claim 23, wherein one of the first and third pieces includes a hinge opening, wherein the hinge includes a hinge pin inserted into the hinge opening and wherein the other of the first and third pieces includes a plate with an opening capturing the hinge pin.

* * * * *